United States Patent [19]

Manizza

[11] Patent Number: 4,476,977

[45] Date of Patent: Oct. 16, 1984

[54] CLOSURE INTERLOCK FOR WRAP AROUND CARTONS AND INCLUDING SEPARATOR TABS

[75] Inventor: Guelfo A. Manizza, Blauvelt, N.Y.

[73] Assignee: Federal Paper Board Company, Inc., Montvale, N.J.

[21] Appl. No.: 370,557

[22] Filed: Apr. 21, 1982

[51] Int. Cl.[3] ..... B65D 65/00; B65D 75/00

[52] U.S. Cl. ..... 206/434; 229/40; 229/89; 229/27

[58] Field of Search ..... 229/40, 27, 89, 15; 24/204; 206/434, 429, 427

[56] References Cited

U.S. PATENT DOCUMENTS

| | | | |
|---|---|---|---|
| 2,911,096 | 11/1959 | Andre | 206/434 |
| 3,963,170 | 6/1976 | Wood | 206/434 |
| 4,029,204 | 6/1977 | Manizza | 206/434 |
| 4,093,116 | 6/1978 | Watkins et al. | 206/434 |
| 4,164,286 | 8/1979 | Sutherland | 206/434 |

FOREIGN PATENT DOCUMENTS

| | | | |
|---|---|---|---|
| 2553533 | 6/1976 | Fed. Rep. of Germany | 206/434 |

*Primary Examiner*—Joseph Man-Fu Moy

*Attorney, Agent, or Firm*—Charles A. Brown

[57] ABSTRACT

This relates to a closure interlock for closure panel assemblies of cartons of the wrap around type. The closure interlock includes portions of inner and outer closure panels and specifically includes a primary locking tab carried by an outer closure panel, and a secondary locking tab and secondary flap carried by an inner closure panel with the boundaries of an opening defined by the secondary locking tab and the secondary flap, when struck from the inner closure panel, also defining primary and secondary locking shoulders. In addition, each secondary flap carries remote from the associated secondary locking tab a separator tab which projects into the interior of the carton and is disposed between items of two adjacent rows to separate such items.

5 Claims, 5 Drawing Figures

CLOSURE INTERLOCK FOR WRAP AROUND CARTONS AND INCLUDING SEPARATOR TABS

This invention relates in general to new and useful improvements in closure interlocks for locking together closure panels of a closure panel assembly of a wrap around carton and more particularly to the addition of a separator tab for each closure interlock, which separator tab may be positioned between items of two adjacent rows of such items to separate the same.

There has been developed a closure interlock wherein an outer closure panel is provided with a primary locking tab which is engageable behind a primary locking shoulder formed on an inner closure panel, and the inner closure panel carries a secondary locking tab, which in turn, is carried by a secondary flap. In accordance with this invention, the secondary flap carries, remote from the secondary locking tab, a separator tab which, in the completed carton, projects into the interior of the carton between adjacent items in the two rows.

With the above and other objects in view that will hereinafter appear, the nature of the invention will be more clearly understood by reference to the following detailed description, the appended claims, and the several views illustrated in the accompanying drawing.

Figure 5:
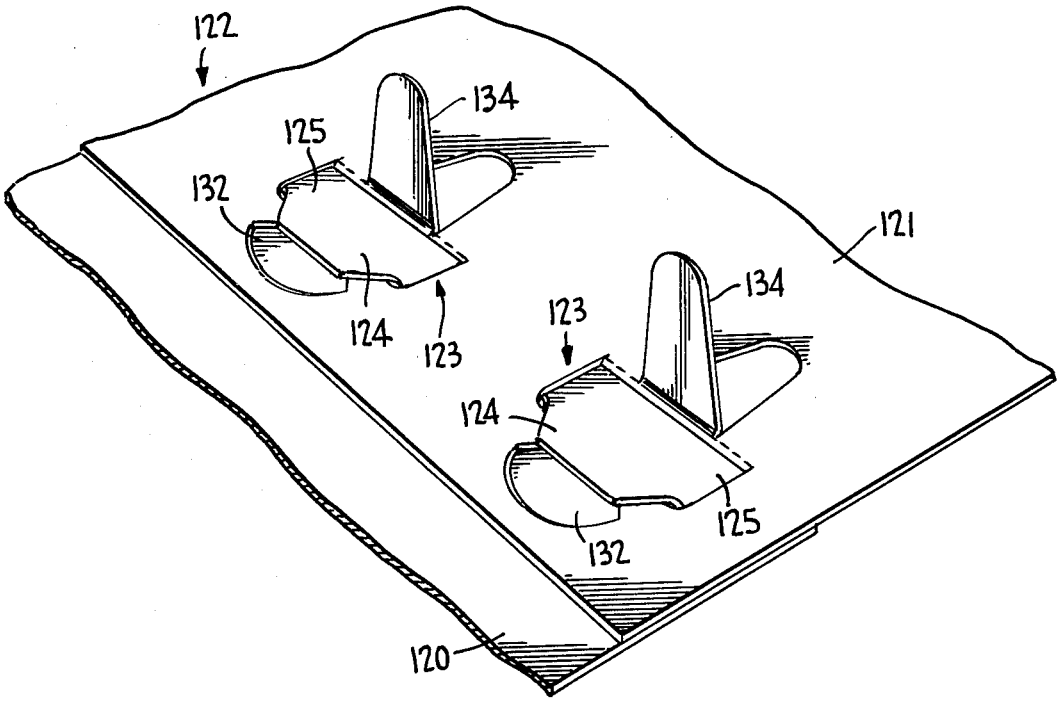
FIG. 5 is a fragmentary perspective view showing the closure panels fully interlocked including the details of two adjacent closure interlocks and their respective separator tabs.

Referring now to the drawings in detail, it will be seen that there is illustrated an outer closure panel 120 and an inner closure panel 121 of a closure panel assembly 122 (FIG. 5) of a carton of the wrap around type intended to have packaged therein items in two rows. The closure panels 120, 121 are secured together by a plurality of closure interlocks 123 which may be aligned with a set or pair of such items within the carton.

Each closure interlock 123 includes a primary locking tab 124 which is carried by a terminal flap portion 125 of the outer closure panel 120. The terminal flap portion 125 and each primary locking tab 124 carried thereby is defined by a series of hinge or fold lines 126 and cut lines 127.

Each closure interlock also includes formed in the inner closure panel 121 by means of a hinge or fold line 128 and cut lines 130 and 131, a secondary locking tab 132, a secondary flap 133 and a separator tab 134. Each secondary locking tab 132 is joined to the secondary flap 133 along a hinge line 135 and includes a narrow neck portion 136 defined by a pair of opposed fingers 137 projecting thereinto.

When the secondary locking tab 132 and the secondary flap 133 are struck out of the inner closure panel 121, an opening 138 is formed with the boundaries of the opening 138 defining primary locking shoulders 140 and secondary locking shoulders 141.

It is also to be noted that the separator tab 134 is hingedly connected to the secondary flap 133 along a fold line 142.

Figure 1:
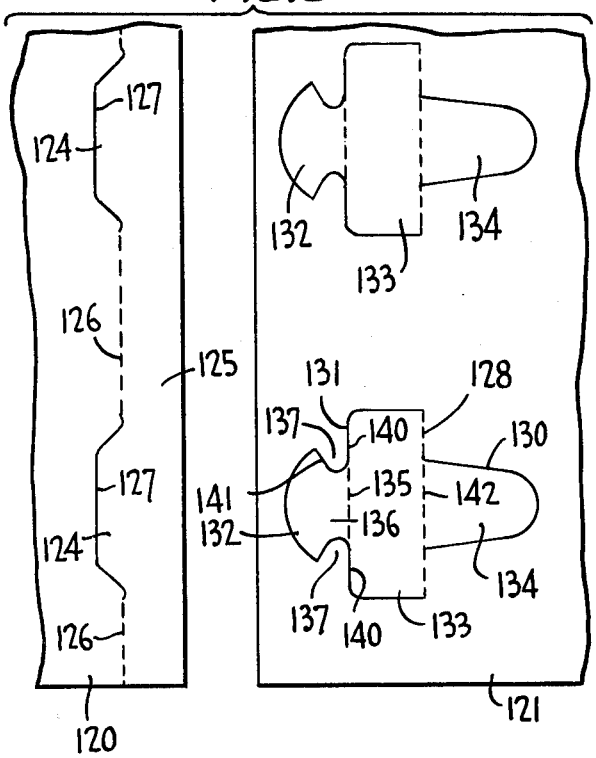
FIG. 1 is an exploded bottom view of two closure panels incorporating the closure interlock and separator tab.
Figure 2:
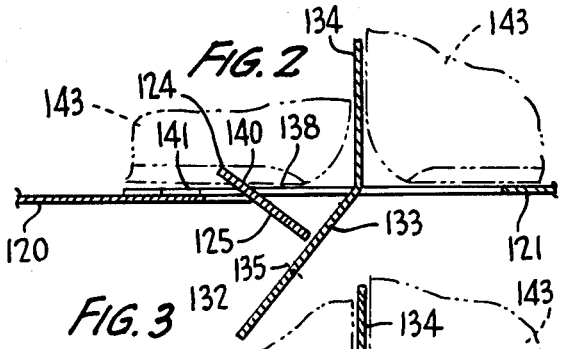
FIG. 2 is a sectional view through one of the closure interlocks showing the closure panels in partial overlapping relation and the primary locking tab engaged behind the primary locking shoulder and the separator tab vertically extending between two adjacent items in initial formation of the closure interlock.

Referring now to FIG. 2, it will be seen that the separator tabs 134 are struck from the inner closure panel 121 so as to assume a generally vertical position and pass between a pair of items 143 which are arranged in two adjacent rows. The illustrated items are bottles, but the items may be any type.

At this time the secondary locking tab 132 and the secondary flap 133 have been struck from the inner closure panel 121 and depend therefrom. Further, the terminal flap portion 125 has been folded downwardly about the fold line 126 and the primary locking tabs 124 have been locked behind the primary locking shoulders 140.

Figure 3:
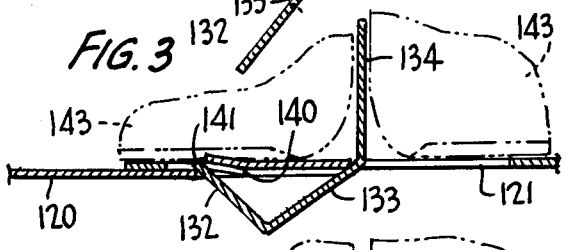
FIG. 3 is a sectional view similar to FIG. 2 and shows the primary locking tab in its fully operative position and a secondary locking tab initially entering into aligned openings in the closure panels.

Referring now to FIG. 3, it will be seen that the terminal flap portion 125 has been swung up beneath the inner closure panel 121 and the primary locking tabs 124 have assumed their fully locked positions. Further, each secondary locking tab 132 has been folded relative to its associated secondary flap 133 and has entered into the aligned openings in the closure panels 120, 121 at a very shallow angle.

Figure 4:
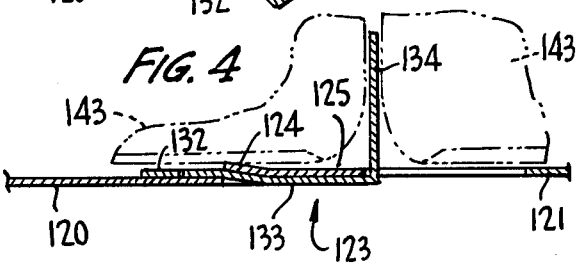
FIG. 4 is another sectional view similar to FIG. 2 and shows the completed closure interlock.

Referring to FIG. 4, it will be seen that in the completed closure interlock, the secondary locking tab 132 has moved to its fully interlocked position wherein the secondary flap 133 underlies the terminal flap portion 125, the secondary locking tab 132 underlies the primary locking tab 124, and the primary locking tab 132 is engaged behind the secondary locking shoulders 141. Further, the secondary locking tab 132 is at least partially seated in that portion of the opening 138 in the inner closure panel 121 from which it was initially struck. The closure interlock 123 is now completed.

It is to be understood that while only two of the closure interlocks 123 have been specifically illustrated, the carton panel assembly 122 may be provided with as many of the closure interlocks 123 as there are items in a row within the carton.

Although only a preferred embodiment of the closure interlock has been specifically illustrated and described herein, it is to be understood that minor variations may be made in the closure interlock without departing from the spirit and scope of the invention as defined by the appended claims.

I claim:

1. A closure interlock for a closure panel assembly of a carton of the wrap around type, said closure interlock comprising an inner closure panel and an outer closure panel each having a free edge, said inner closure panel having struck therefrom a secondary locking tab carried by a flap with said secondary locking tab facing said free edge of said inner closure panel, the displacement of said secondary locking tab and said flap from said inner closure panel defining an opening in said inner closure panel having as a boundary thereof a primary locking shoulder, and said outer closure panel having a terminal flap portion in part defined by a fold line and in part by cut line means, said cut line means defining a primary locking tab carried by said terminal edge flap portion and facing away from said outer closure panel free edge for locking behind said primary locking shoulder, said secondary locking tab being connected to said secondary flap by a narrow neck portion defining a secondary shoulder on said inner closure panel and facing away from said primary locking shoulder, and a separator tab hingedly carried by said secondary flap.

2. A closure interlock according to claim 1 wherein said secondary locking tab engages behind said secondary locking shoulder.

3. A closure interlock of the type including overlapping inner and outer closure panels, said outer closure panel having a terminal flap portion carrying a primary locking tab for locking engagement with said inner closure panel, said inner closure panel having struck therefrom a secondary flap carrying a secondary locking tab, and wherein said secondary flap underlies said terminal flap portion and said secondary locking tab in part underlies said primary locking tab and is generally seated in an opening in said inner closure panel from which said secondary locking tab is formed.

4. A closure interlock according to claim 1 wherein said secondary locking tab is aligned with said separator tab and disposed on an opposite edge of said secondary flap.

5. A closure interlock according to claim 1 wherein in a completed carton containing packaged items in two rows, said separator tab extends between items in said two rows, and said locking tabs underlie one of said items.

* * * * *